US006041952A

United States Patent [19]

Martin

[11] Patent Number: 6,041,952

[45] Date of Patent: Mar. 28, 2000

[54] INSULATED CONTAINER APPARATUS

[75] Inventor: Kevin P. Martin, Glendale, Ariz.

[73] Assignee: Polar Peaks, LLC, Phoenix, Ariz.

[21] Appl. No.: 09/144,617

[22] Filed: Aug. 31, 1998

Related U.S. Application Data

[63] Continuation-in-part of application No. 29/084,854, Mar. 12, 1998.

[51] Int. Cl.[7] ..... B65D 1/48

[52] U.S. Cl. ..... 215/12.1; 220/592.16; 220/592.24

[58] Field of Search ..... 215/12.1, 12.2, 215/13.1, 382, 383, 384; 220/592.16, 592.17, 592.24, 592.2, 592.25, 592.26, 62.11, 62.12, 62.22, 560.15, 739, 915.2, DIG. 9, 23.91

[56] References Cited

U.S. PATENT DOCUMENTS

| | | | |
|---|---|---|---|
| D. 63,400 | 12/1923 | Husting . | |
| D. 102,910 | 1/1937 | Lorenzen . | |
| D. 138,663 | 8/1944 | Teunisz . | |
| D. 176,487 | 12/1955 | Sherman . | |
| 3,221,954 | 12/1965 | Lux | 215/12.2 |
| 3,779,298 | 12/1973 | Piccirilli et al. | 220/62.12 |
| 4,342,399 | 8/1982 | Stirling | 215/12.2 |
| 4,610,366 | 9/1986 | Estes et al. . | |
| 4,759,454 | 7/1988 | Nowicki et al. | 215/12.1 |
| 4,796,937 | 1/1989 | Andrea | 220/592.24 |
| 5,222,656 | 6/1993 | Carlson . | |
| 5,579,949 | 12/1996 | Dykes et al. . | |
| 5,628,453 | 5/1997 | MacLaughlin . | |

*Primary Examiner*—Stephen Castellano
*Attorney, Agent, or Firm*—Quarles & Brady LLP

[57] ABSTRACT

Container apparatus for a liquid, such as a beverage, includes a generally cylindrical container element with a circumferentially extending and axially elongated recess with an insulative sleeve disposed in the recess. The insulative sleeve helps to maintain the desired temperature of the liquid within the container. The insulative jacket is preferably made of closed cell foam and it fits into the recess and is held in place therein by shoulders which extend outwardly from the recessed wall.

7 Claims, 1 Drawing Sheet

INSULATED CONTAINER APPARATUS

CROSS REFERENCE TO RELATED APPLICATION

This application is a continuation-in-part application of Ser. No. 29/084,854, filed on Mar. 12, 1998.

BACKGROUND OF THE INVENTION

1. Field of the Invention

This invention relates to beverage containers and, more particularly, to beverage containers which include an insulative sleeve for helping to maintain the desired temperature of the beverage or liquid in the container.

2. Description of the Prior Art

Containers for liquids, or beverages, may include plastic containers, glass containers, metal containers, or ceramic containers. Typically, an insulative cup holder, or the like, must be used to keep the liquid or beverage at its desired temperature.

The apparatus of the present invention overcomes the limitations of the prior art by providing an insulative sleeve disposed about the container for maintaining the liquid or beverage at its desired temperature.

SUMMARY OF THE INVENTION

The invention described and claimed herein comprises a generally cylindrical container for a liquid, such as a beverage, with a circumferentially extending recessed area for receiving an insulative sleeve. The beverage container may made of any appropriate material, such as plastic, metal, glass, or the like. The recessed area holds the insulative sleeve in place and the insulative sleeve extends for a substantial axial length of the container.

Among the objects of the present invention are the following:

To provide new and useful container apparatus for liquid;

To provide new and useful container apparatus for liquid in which the apparatus includes a recessed area for receiving an insulative sleeve;

To provide new and useful container having a recess for receiving an insulative sleeve;

To provide new and useful cylindrical container apparatus including a circumferentially extending insulative sleeve; and To provide new and useful container apparatus including an axially extending recess for receiving an insulative jacket.

DESCRIPTION OF THE PREFERRED EMBODIMENT

Figure 1:
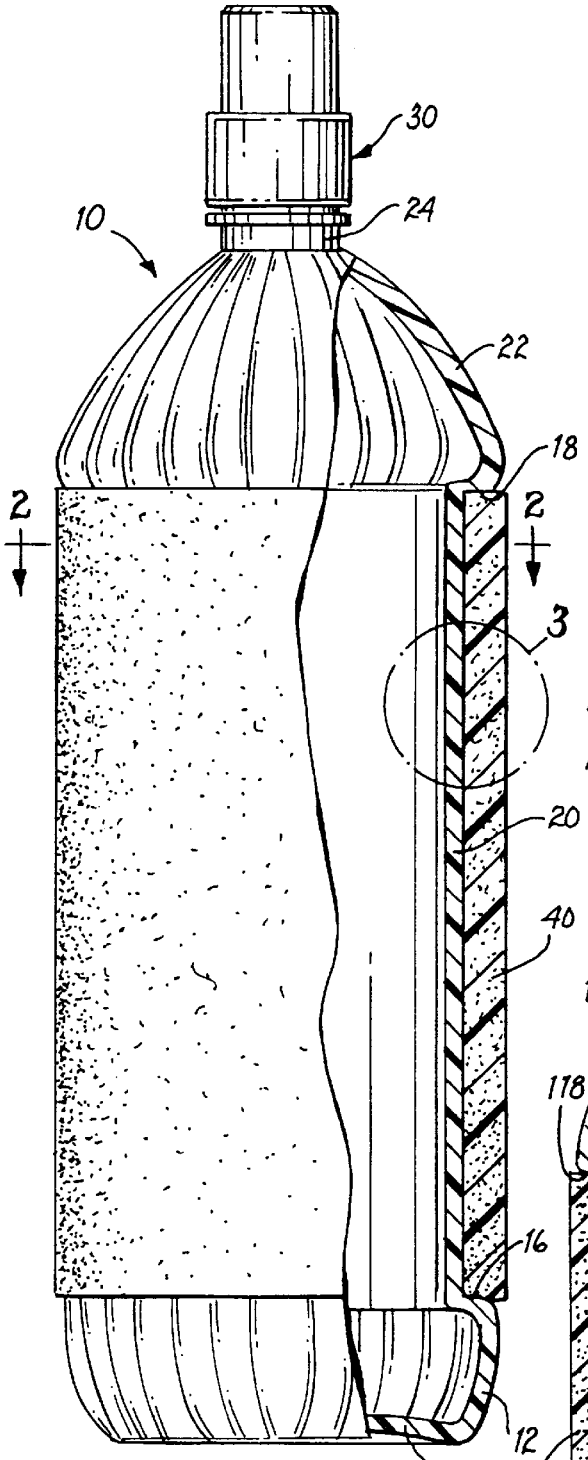
FIG. 1 is a side view in partial section of the apparatus of the present invention.
Figure 2:
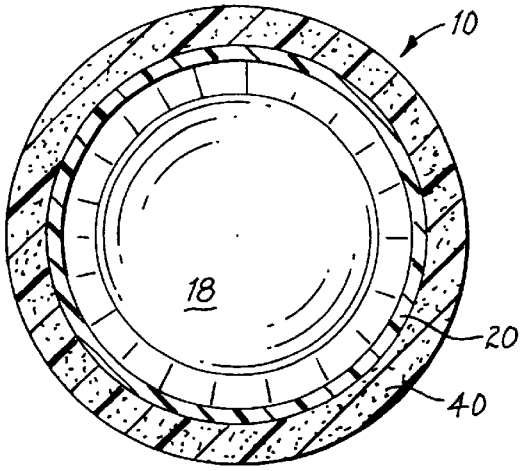
FIG. 2 is a view in partial section taken generally along line 2—2 of FIG. 1.
Figure 3:
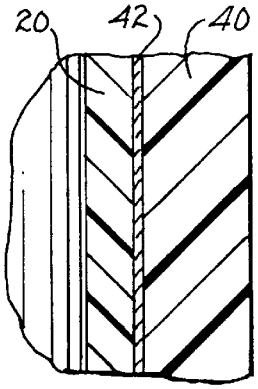
FIG. 3 is an enlarged view in partial section taken generally from circle 3 of FIG. 1.

FIG. 1 is a side view in partial section of container apparatus 10 embodying the present invention. FIG. 2 is a view in partial section through the apparatus 10 taken generally along line 2—2 of FIG. 1. FIG. 3 is an enlarged view in partial section taken generally from circle 3 of FIG. 1. For the following discussion, reference will primarily be made to FIGS. 1, 2, and 3.

The container apparatus 10 includes a lower cylindrical wall 12 which extends generally upwardly from a bottom wall 14. Extending circumferentially inwardly from the lower cylinder wall 12 is a lower shoulder 16. Generally parallel to the lower shoulder 16 is a circumferentially and inwardly extending upper shoulder 18. The outer diameter of the upper shoulder 18 is slightly larger than the outer diameter of the lower shoulder 16.

Extending between the inner portions of the shoulder 16 and 18 is a recessed and circumferentially extending cylinder wall 20.

Extending generally upwardly and inwardly from the upper shoulder 18 is a upwardly and inwardly tapered upper cylinder wall 22. The cylinder wall 22 terminates in a generally vertically and cylindrically neck 24. A fill and spout assembly 30 is secured to the neck 24 in an appropriate, well known manner. The fill and spout assembly 30 is a generally well known and understood assembly.

Extending between the shoulders 16 and 18, and about the recessed cylinder wall 20, is an insulative sleeve 40.

Referring specifically to FIG. 3, an adhesive layer 42 may be disposed between the cylinder wall 20 and the insulative sleeve 40, if desired. The adhesive layer 42 may be desired for certain purposes or under certain circumstances, but generally such adhesive layer is not necessary.

As indicated above, the outer diameter of the container 10 at the lower shoulder 16 is slightly less than the outer diameter of the container 10 at the upper shoulder 18. This allows the insulative sleeve 40 to be inserted onto the recessed cylinder wall 20 from the bottom. There is a slight outward taper of the lower cylinder wall 12 which aids in slipping the sleeve 40 over the lower portion of the container apparatus 10 and about the recess cylinder wall 20.

The insulative sleeve 40 is preferably made of closed-cell foam, and there is sufficient inherent flexibility and elasticity to allow the sleeve 40 to slip over the outer diameter of the shoulder 16 and onto the recess defined between the shoulders 16 and 18 and the wall 20 and then to allow the sleeve 40 to return to its original configuration so as to provide the function for which it is designed, namely to insulate a major axial portion of the container apparatus 10.

Once installed, the insulative sleeve 40 will remain in place, with the shoulders 16 and 18 providing the necessary end elements to prevent the longitudinal or axial movement of the sleeve 40.

With a liquid, such as water, within the container 10, a user simply grasps the container in any desired manner, typically about the sleeve 40. With the upper shoulder 18 having a slightly greater diameter than the lower shoulder 16, the upper shoulder provides a definite limit on the ability of the sleeve 40 to move axially or longitudinally relative to the container element about which it is disposed.

Obviously, with the well-known fill and spout assembly 30, the container apparatus 10 may be filled and refilled as desired. While the container apparatus 10 will typically be used with a cool or cold liquid, it is obvious that the insulative sleeve 40 also provides insulation if the container apparatus 10 is filled with a warm or hot liquid.

Figure 4:
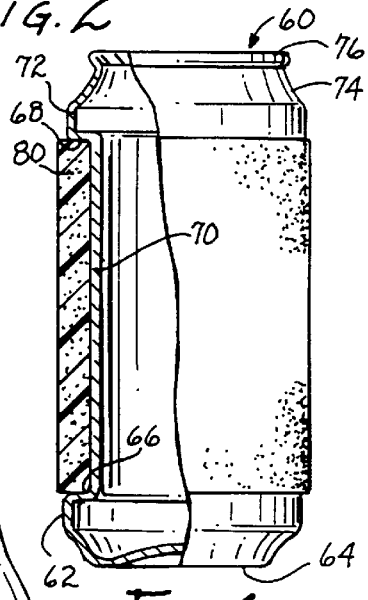
FIG. 4 is a side view in partial section illustrating an alternate embodiment of the apparatus of the present invention.

FIG. 4 is a side view in partial section of an alternate container embodiment 60 which comprises a can made of metal and with an insulative sleeve disposed about the can. The container apparatus 60, made of metal, as indicated above, typically aluminum, includes a lower cylinder wall 62 which extends upwardly from a bottom 64. A lower shoulder 66 extends generally inwardly from the upper portion of the lower cylinder wall 62. Generally parallel to the lower shoulder 66 is an upper shoulder 68. Between the shoulders 66 and 68 is a recessed cylinder wall 70.

Extending upwardly from the upper shoulder 68 is an upper cylinder wall 72. The upper cylinder wall 72 includes an inwardly tapering portion 74 which extends to a top 76. On the top 76 may be the tabs so well known and understood in the aluminum or steel can art.

An insulative sleeve 80 is disposed in the recess defined by the shoulders 66 and 68 and the recessed cylinder wall 70.

The insulative sleeve 80 provides substantially the same insulative function relative to the can embodiment 60 as does the sleeve 40 for the container apparatus 10. The container apparatus 60 differs from the container apparatus 10 primarily in the fact that it is made of metal as opposed to the container 10 which is made of plastic.

As with the apparatus 10, the outer diameter of the upper cylinder wall 72 is slightly greater than the outer diameter of the lower cylinder wall 62, thus allowing the sleeve 80 to be moved into the recess and about the cylinder wall 70 from the bottom. Again, there may be a slight taper, mainly for convenience, of at least a portion of the lower cylinder wall 62 to aid in the insertion of the sleeve 80 on to the cylinder wall 70.

Figure 5:
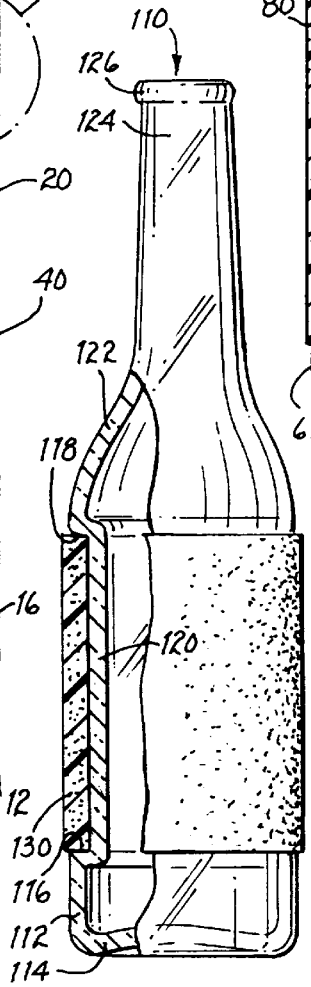
FIG. 5 is a side view in partial section of another alternate embodiment of the apparatus of the present invention.

A third embodiment of the apparatus of the present invention is illustrated in FIG. 5. FIG. 5 comprises a view in partial section of container apparatus 110 of the present invention. The container apparatus 110 is a bottle made of glass, and with an insulative sleeve disposed about a recessed portion of the glass wall of the container apparatus 110.

The container apparatus 110 includes a lower cylinder wall 112 which extends generally upwardly from a bottom 114. The lower cylinder wall 112 terminates in an inwardly extending lower shoulder 116. Generally parallel to the lower shoulder 116 is an upper shoulder 118. Between the two shoulders 116 and 118 is a recessed cylinder wall 120.

Extending upwardly from the upper shoulder 118 is an upper cylinder wall 122. The upper cylinder wall 122 extends or tapers generally inwardly and upwardly to an upper neck 124. The upper neck 124 terminates in a top 126.

An insulative sleeve 130 is disposed about the recessed cylinder wall 120 between the two shoulders 116 and 118.

Like the other container embodiments 10 and 60, the outer diameter of the cylinder wall 112 at the shoulder 116 is slightly less in diameter than the cylinder wall 122 at the shoulder 118. Again, this allows the sleeve 120 to be slipped onto the container 110 from the bottom, and provides a limit, or an upper limit, to help hold the sleeve 130 in place during use.

The container 110 is, obviously, easily filled through the top 126 and may be appropriately capped, as desired. While a generally round top 126 is shown, it is obvious that the top may be threaded, or otherwise, to receive an appropriate cap (not shown).

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Container apparatus comprising in combination:

a bottom;

a wall extending upwardly from the bottom, including a lower wall portion;

a lower shoulder extending inwardly on the lower wall portion, an upper shoulder extending inwardly remote from the lower shoulder, and a recessed wall portion extending between the lower and upper shoulders; and an insulative sleeve disposed about the recessed wall portion between the lower and upper shoulders;

said lower shoulder and upper shoulder each having an outer diameter, wherein the outer diameter of the upper shoulder is greater than the outer diameter of the lower shoulder.

2. The apparatus of claim 1 in which the insulative sleeve is made of closed cell foam.

3. The apparatus of claim 1 in which the wall is made of material from the group consisting of plastic or glass.

4. The apparatus of claim 1 in which the insulative sleeve is sufficiently flexible and elastic to permit the sleeve to slip over the lower shoulder and into the recessed wall portion, and to return to its original configuration once in place.

5. Container apparatus comprising in combination:

a bottom;

a wall extending upwardly from the bottom, including a lower wall portion;

a lower shoulder extending inwardly on the lower wall portion, an upper shoulder extending inwardly remote from the lower shoulder, and a recessed wall portion extending between the lower and upper shoulders; and an insulative sleeve disposed about the recessed wall portion between the lower and upper shoulders, said insulative sleeve comprising a tubular closed cell foam piece adapted to maintain a desired temperature for a liquid in the container, and said insulative sleeve having a thickness treater than a thickness for the wall.

6. The apparatus of claim 5 in which the wall is made of material from the group consisting of plastic or glass.

7. The apparatus of claim 5 in which the insulative sleeve is sufficiently flexible and elastic to permit the sleeve to slip over the lower shoulder and into the recessed wall portion, and to return to its original configuration once in place.

* * * * *

UNITED STATES PATENT AND TRADEMARK OFFICE

CERTIFICATE OF CORRECTION

PATENT NO : 6,041,952

DATED : March 28, 2000

INVENTOR(S) : Kevin P. Martin

It is certified that error appears in the above-identified patent and that said Letters Patent is hereby corrected as shown below:

The word "treater" in the last line of claim 5 should read:

-- greater --.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*